United States Patent [19]

Posgate

[11] 4,133,761

[45] Jan. 9, 1979

[54] SUBMERGED SETTLER FOR SUSPENDED SOLIDS

[76] Inventor: Edward S. Posgate, 48 Roberts Crescent, Brampton, Ontario, Canada, L6W 1G8

[21] Appl. No.: 810,670

[22] Filed: Jun. 28, 1977

Related U.S. Application Data

[63] Continuation-in-part of Ser. No. 790,259, Apr. 25, 1977, abandoned.

[51] Int. Cl.[2] ..... E02B 5/08

[52] U.S. Cl. ..... 210/170; 406/74; 210/199; 210/519

[58] Field of Search ..... 210/170, 199, 201, 206, 210/513, 220, 519; 61/2, 69 R; 261/119 R, 123, 125, DIG. 75, 106; 119/3, 5; 43/56

[56] References Cited

U.S. PATENT DOCUMENTS

| | | | |
|---|---|---|---|
| 1,094,310 | 4/1914 | Deal | 61/2 |
| 1,431,367 | 10/1922 | Buchi | 61/2 |
| 2,463,808 | 3/1949 | Russel | 61/2 X |
| 3,013,395 | 12/1961 | Gaylord | 61/2 |
| 3,452,966 | 7/1969 | Smolski | 261/123 X |
| 3,470,091 | 9/1969 | Budd et al. | 210/220 X |
| 3,515,378 | 6/1970 | Hill | 261/106 |
| 3,609,979 | 10/1971 | Lukawsky | 61/2 |
| 3,638,432 | 2/1972 | Schoonmaker | 61/2 |
| 3,664,136 | 5/1972 | Laval, Jr. et al. | 61/69 R X |
| 3,701,426 | 10/1972 | Wetzel | 210/199 X |
| 3,790,141 | 2/1974 | Champeau | 261/123 X |
| 3,799,349 | 3/1974 | Stewart | 61/2 X |
| 3,879,953 | 4/1975 | Clark | 61/69 R X |

*Primary Examiner*—Richard L. Chiesa
*Attorney, Agent, or Firm*—Fetherstonhaugh & Co.

[57] ABSTRACT

In a water treatment plant which extracts water from a large open main body of water, the improvement of; a settling enclosure submerged in said main body of water and having a settling chamber therein which is isolated from the main body of water by an enclosure wall, a substantially quiescent body of water located within said settling chamber, input passage means communicating between said settling chamber and said main body of water for admitting water to said settling chamber, output passage means communicating between said settling chamber and said water treatment plant for conveying water from said quiescent body of water to said water treatment plant, said quiescent body of water having a volume which is substantially greater than the instantaneous requirements of said water treatment plant whereby water entering said settling chamber is held in a substantially quiescent state within said settling chamber for a period of time sufficient to ensure that the turbidity of water drawn from the quiescent body by way of said output conduit is substantially constant and unaffected by turbidity conditions in the main body of water.

26 Claims, 7 Drawing Figures

SUBMERGED SETTLER FOR SUSPENDED SOLIDS

This is a continuation-in-part of U.S. patent application Ser. No. 790,259, filed Apr. 25, 1977, now abandoned.

FIELD OF INVENTION

This invention relates to water treatment plants. In particular, this invention relates to a submersible settling enclosure for use with a water treatment plant in order to minimize variations in turbidity of water drawn from a large body of water for treatment.

PRIOR ART

Drinking water treatment plants operate most efficiently when turbid suspensions are uniform and low in concentration. If such input conditions to a drinking water treatment plant can be sustained, a substantial saving in treatment chemicals can be achieved and the treatment can be simplified and a larger reserve of capacity can be obtained.

The turbidity in a large body of raw water in a large body of water varies quite considerably in response to variations in weather conditions and seasonal changes and marine traffic. Prior to a storm, the turbidity of water entering a water treatment plant may be very low and may increase greatly under storm conditions and remain at an increased level for several days following a storm. Similar variations can result from seasonal changes. The turbidity of a body of water during winter months may be substantially consistent at a low level but may increase dramatically during ice breakup and spring run-off conditions.

In addition, marine traffic passing near the intake of a water treatment plant can cause a sharp increase in the concentration of suspended material. Other marine activities such as dredging operations can also cause a large increase in turbidity. In many instances, increases in turbidity caused by marine traffic and the like cannot be predicted, with the result that the increase may place an unexpected load on the water treatment process.

A process in which drinking water is treated with polymers and direct filtration has become increasingly popular in recent years. The capital cost required to establish a plant to operate on this new process is substantially less than that required for plants operating according to previously known processes. The new plants do not require large settling reservoirs and, as a result, are much less costly. However, the process can only be employed where raw surface waters having a very low turbidity is available. As previously indicated, all plants which use surface waters of a large body of water as a source are vulnerable to changes in weather, seasonal conditions and maritime traffic. As a result, there is a danger that the variations in turbidity may result in overfeeding or underfeeding of chemicals such as the treatment polymers.

If underfeeding occurs, there is a danger of fine suspensions passing through the filter which may contain pathogenic micro-organisms which cannot be destroyed by chlorination. If overfeeding occurs, the excess treatment materials may themselves constitute a health hazard.

In the present water treatment process it is mandatory to proportion the input of polymers to variations in the concentration of suspension and variations in flow rate. While these two variables can be monitored, difficulties can arise in situations where there is a sudden change in turbidity resulting from a storm or flash flood. In addition, under conditions of high turbidity the output of the water treatment plant can be severely curtailed.

The present invention seeks to overcome the difficulties of the prior art described above by providing a source of raw water in which the variation in turbidity is minimized.

SUMMARY OF INVENTION

According to one aspect of the present invention, there is provided in a water treatment plant which extracts water from a large open main body of water, the improvement of a settling enclosure submerged in said main body of water and having a settling chamber therein which is isolated from the main body of water by an enclosure wall, a substantially quiescent body of water located within said settling chamber, input passage means communicating between said settling chamber and said main body of water for admitting water to said settling chamber, output passage means communicating between said settling chamber and said water treatment plant for conveying water from said quiescent body of water to said water treatment plant, said quiescent body of water having a volume which is substantially greater than the instantaneous requirements of said water treatment plant whereby water entering said settling chamber is held in a substantially quiescent state within said settling chamber for a period of time sufficient to ensure that the turbidity of water drawn from the quiescent body by way of said output conduit is substantially constant and unaffected by turbidity conditions in the main body of water.

According to a further aspect of the present invention, there is provided a submersible settling enclosure comprising a flexible enclosure wall defining a settling chamber, means for retaining peripheral edge portions of said enclosure in a position sealed against the bed of a large body of water, buoyancy means located within said enclosure for supporting a portion of said enclosure wall above said bed to maintain the settling chamber in an expanded configuration when submerged, input passage means opening through said flexible enclosure wall for admitting water to said settling chamber and output passage means opening outwardly from said settling chamber for discharging water therefrom.

PREFERRED EMBODIMENT

The invention will be more clearly understood with reference to the following detailed specification read in conjunction with the drawings wherein.

Figure 1:
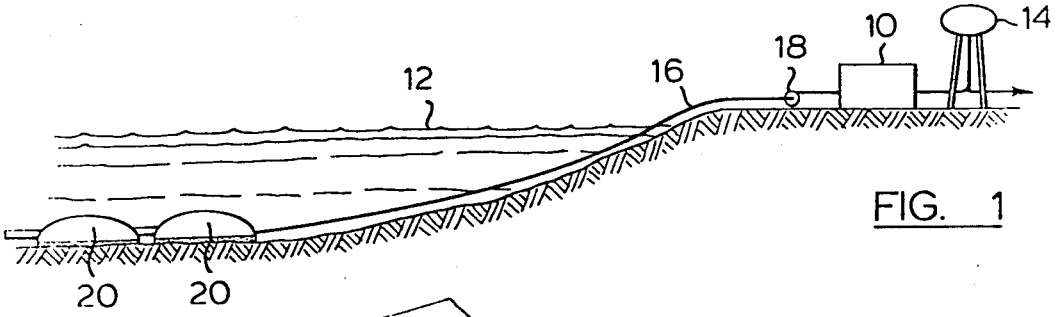
FIG. 1 is a diagrammatic illustration of a water treatment plant according to one aspect of the present invention.

With reference to FIG. 1 of the drawings, the reference numeral 10 refers to a water treatment plant which draws water from a large open body of water 12 and delivers treated water to a storage tank 14. Water is withdrawn from the body of water 12 through line 16 by means of a pump 18. Before entering the line 16, the water passes through submerged settling enclosures 20.

Figure 2:
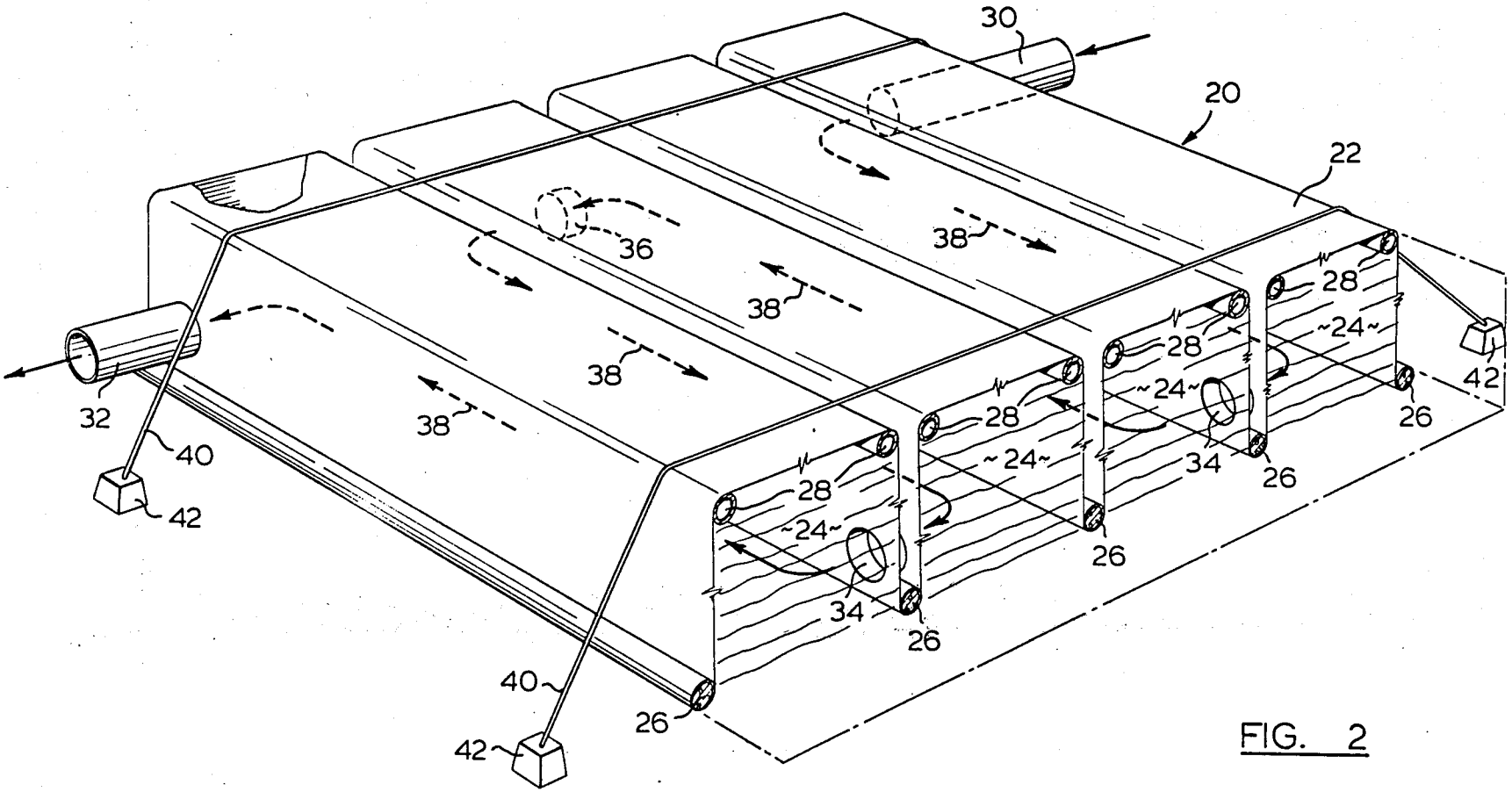
FIG. 2 is a partially sectioned pictorial view of a settling enclosure.

FIG. 2 of the drawings illustrates one form of submerged settling enclosure 20. In this embodiment, the enclosure 20 is formed from a flexible web 22 of an opaque flexible reinforced thermoplastic membrane which will not degrade during twenty years of continuous submersion in water such as TEFLON (Trade Mark), reinforced polyethylene or reinforced nylon or the like. The web 22 is folded on itself to form a plurality of compartments 24. Weighted pipes 26, which are preferably plastic pipes filled with weighting filler material 27 which may be rigid or flexible serve to retain the lower edge portions of each compartment against the bed of the body of water and hollow buoyant pipes 28 serve to support the compartments in an open position. Concrete is a suitable rigid filling material and sand forms a suitable flexible material. The buoyant pipes 28 float in the water which is located within each compartment 24 in use. Water is admitted to the enclosure 20 through input passage 30 and is discharged through output passage 32. The input passage 30 is of larger diameter than the output passage 32 so that the inlet velocity is substantially less than the output velocity. Adjacent compartments 24 are connected to one another by conduits 34 and 36. The conduits 34 and 36 are positioned so that water entering the first compartment 24 by way of passage 30 must pass along the length of the first compartment 24 before passing through conduit 34 to enter the second compartment and thereafter the water must again pass along the length of the second compartment before entering the third compartment through conduit 36 and so forth so that the water follows the path outlined by arrows 38. The entire settling enclosure is anchored by anchoring cables 40 which extend between anchoring blocks 42 at either side of the enclosure.

In use, one or more settling enclosures of the type illustrated in FIG. 2 of the drawings may be required to provide the input capacity for a water treatment plant. Where more than one settling enclosure is required, two such enclosures may be connected in series or in parallel to provide the required capacity.

It will be seen that water entering the input passage 30 passes into a first compartment 24 and thereafter it is not subjected to the turbulent conditions of the larger body of water so that the suspended particles in the water have an opportunity to settle out. The compartments 24 provide settling chambers in which a substantially quiescent body of water may be stored. The flexible enclosure wall may yield somewhat when subjected to underwater currents. However, the buoyant floats 28 will serve to return the flexible wall to the open configuration when the influence of currents is removed. Thus, the water located within the enclosure is subjected to disturbances which are minimal when compared with those applied to the main body of water by currents caused by storm conditions or the like. By constructing the flexible enclosure wall 22 from an opaque material, sunlight is not admitted to the enclosure and consequently the growth of algae and vegetation within the enclosure is inhibited by lack of sunlight.

Figure 3:
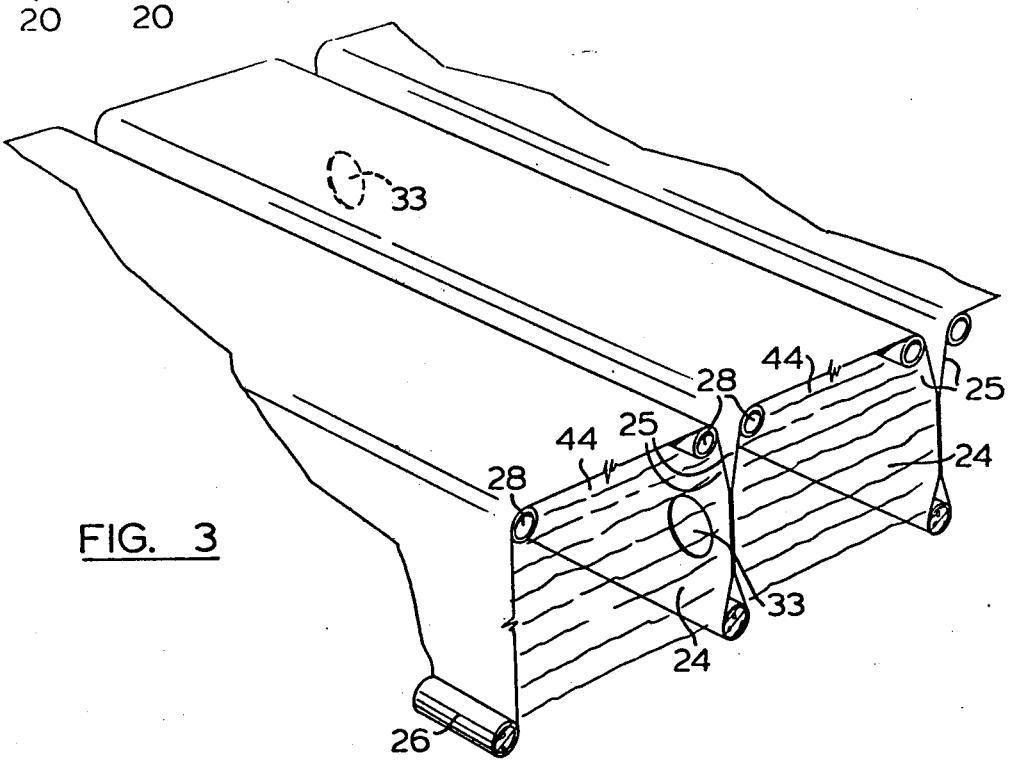
FIG. 3 is a partially sectioned pictorial view of a settling enclosure of a further embodiment of the invention.

FIG. 3 of the drawings illustrates a further embodiment of the invention in which adjacent side walls 25 of the compartments 24 are fused together in the area of the connecting passage 33, thus eliminating the need for the connecting conduit 34. As shown in FIG. 3 of the drawings, when the compartments 24 are filled with water an air space 44 is provided above the buoyant supports 28. The air space 44 further serves to maintain the compartments 24 in an open configuration as water is withdrawn from the compartments 24. An air input line, such as that described hereinafter with reference to FIG. 4 of the drawings, may be provided for admitting air to each air space 44.

Figure 4:
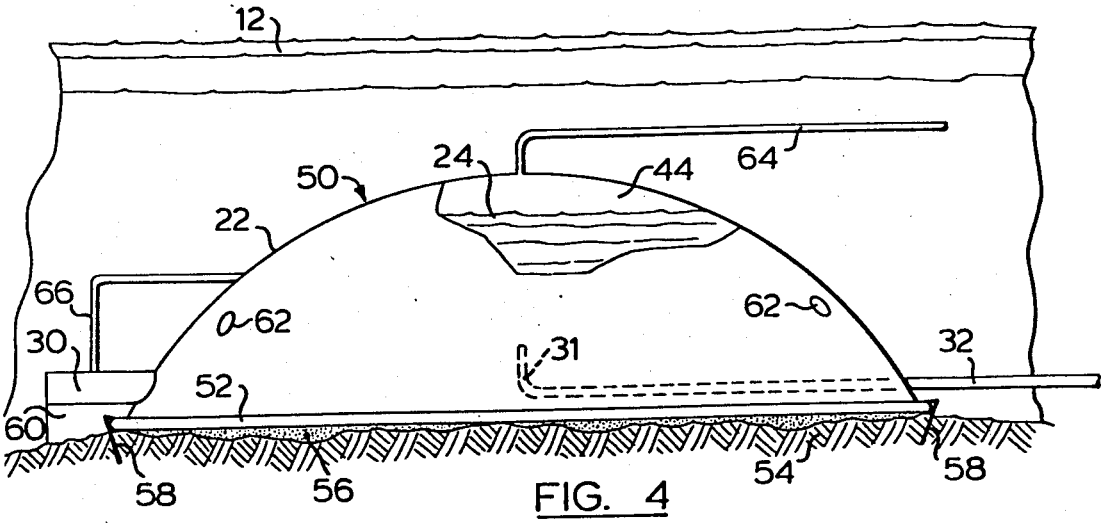
FIG. 4 is a partially sectioned side view of a settling enclosure constructed in accordance with a still further embodiment of the invention.

FIG. 4 of the drawings illustrates a settling enclosure 50 constructed in accordance with a further embodiment of the present invention. In this enclosure, the flexible enclosure wall 22 is in the form of a dome, the lower edge of which is secured to a peripheral ring 52. A concrete base 56 is laid down on the bed 54 of the body of water to provide a flat support for the peripheral ring 52 and anchor pins 58 secure the peripheral ring 52 to the bed 54. Water from the main body of water 12 enters the water storage compartment 24 by way of inlet conduit 30 which is supported by a support structure 60. Water is withdrawn from the enclosure 24 through output conduit 32. It will be noted that the inner end 31 of the conduit 32 is raised above the bottom of the enclosure. After a period of use, sediment will build up on the bottom of the enclosure and the lower end 31 of the outlet pipe is raised above the bottom so that it will withdraw water from the enclosure at a level sufficient to permit a substantial build up of sediment to occur before it is necessary to clean out the enclosure. A plurality of small access windows 62 open through the flexible wall to provide access to the storage compartment 24 for a silt removing suction pipe which will permit periodic removal of sediment deposited in the storage compartment as a result of settling. A resealable patch may be provided at each window 62 so that the windows are only open when the cleaning operation takes place.

Air is admitted to the air space 44 by means of conduit 64 which is connected to a suitable source of air such as a compressor at the water processing plant.

Water treatment polymers or the like may be admitted to the water entering the enclosure with intake conduit 30 by means of a feed line 66 connected to a source of polymer supply at the processing plant. The provision of a polymer supply line serves to permit the enclosure to be used as a preliminary water treatment enclosure in addition to a submerged settling tank.

In use, water entering the conduit 30 may receive a water treatment additive such as a polymer by way of line 66. The water storage compartment has a capacity sufficient to provide the retention time required to achieve an acceptable settling of suspended solids. The capacity of a compartment or a series of compartments may be calculated from the average daily flow rate of a plant and the settling rate of the solids which would be a characteristic of the location. Air entering the air space 44 by way of conduit 64, together with the stored body of water, serves to retain the flexible wall 22 in the expanded position illustrated in FIG. 2 of the drawings. As previously indicated, the flexible wall is preferred to a rigid structure. However, it will be understood that a rigid structure could be employed to provide the submerged settling tank if required. The rigid structures would, however, be subject to high impact loads and stresses and would be more expensive to fabricate. Water is withdrawn from the settling chamber through conduit 32.

Figure 5:
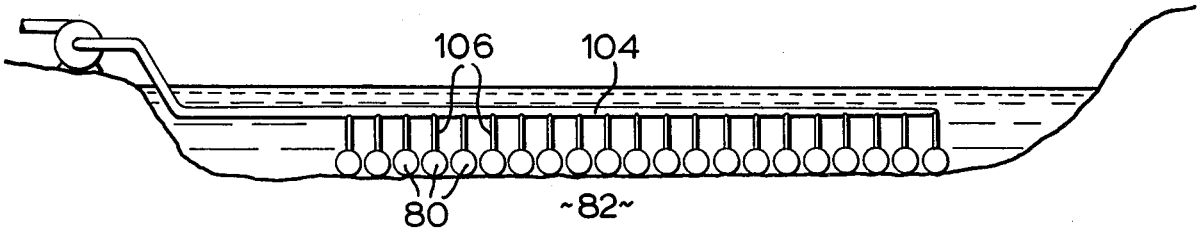
FIG. 5 is a sectional side view of a water treatment plant according to a further aspect of the present invention.
Figure 6:
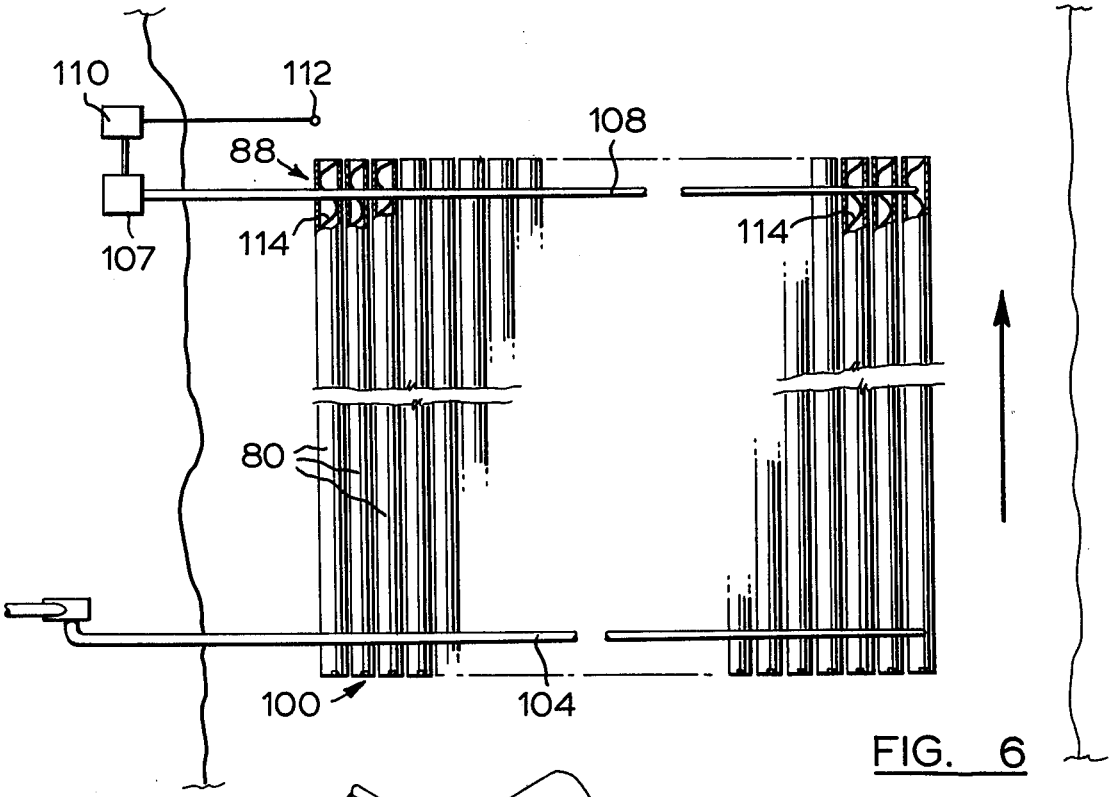
FIG. 6 is a plan view of the plant of FIG. 5.
Figure 7:
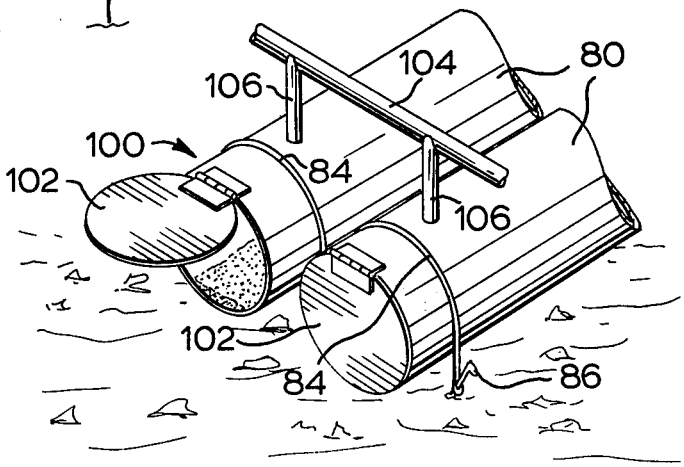
FIG. 7 is an enlarged pictorial end view showing one of the conduits open for flushing and an adjacent conduit closed to prevent flushing.

FIGS. 5, 6 and 7 of the drawings illustrate an improvement in a water treatment plant which is particularly suitable for use in a plant which extracts water from a flowing body of water such as a river or stream. In this embodiment, conduits 80 are located on the bed 82 of the stream in a side by side parallel relationship extending longitudinally of the stream in the direction of flow of the stream. The conduits 80 are secured with respect to the bed of the stream by means of anchor cables 84 and anchoring pins 86 or the like. The conduits may be made from an extruded plastic material or the like and may have sufficient longitudinal flexibility to follow a relatively uneven bed of a stream or the like. The wall of each conduit may, however, be substantially rigid. Each conduit 80 has an input end 88 and an output end 100. The input end 88 is open and the conduits are preferably arranged so that the input end 88 opens in the downstream direction so that there is no direct flow of water into the input ends. The output ends 100 each have a releasable closure flap 102 hingedly connected thereto. The flap 102 is movable from the open position shown in one conduit illustrated in FIG. 7 to the closed position shown in the other conduit illustrated in FIG. 7. The output ends 100 of the conduits are connected to a manifold 104 by conduits 106 so that water may be extracted from each conduit simultaneously. The manifold 104 may be proportioned and adapted to ensure that a substantially equal quantity of water is extracted from each of the conduits so that the dwell time in each conduit is substantially the same. In order to aid the settling out of suspended material from the water as it enters the input end 88 of each conduit, water treatment polymer is introduced by a pumping system generally identified by the reference numeral 107 through a manifold 108 and suitable connecting conduits similar to the conduits 106.

The turbidity of the water flowing in the stream may be measured by a turbidimeter 110 having a probe 112 located in the stream. The turbidimeter 110 may be connected to the pumping system 107 of the polymer additive system to control the rate at which polymer is added in response to variations in the turbidity of the water in the stream. Baffles 114 are located at the input end of each conduit to establish a mixing turbulence at the point where the polymer is added to the water so that the polymer is thoroughly mixed with the water entering the settling chambers formed by the conduits.

In use, water is drawn into the conduits by way of the open input ends 88 and as previously indicated the turbulence is induced in the input water as it is drawn over the baffles 114. Water treatment polymers are added to the water at the input end in proportions determined by the turbidity of the water in the stream as monitored by the turbidimeter 110. The water is drawn through each conduit 80 to the output end 100. The closure flap 102 of each conduit is normally closed. Water is drawn from the output end 100 of each conduit through conduits 106 to manifold 104 and thereafter the water is pumped from the conduit 104 to a water treatment plant.

The conduits are proportioned to form a settling enclosure which has a capacity capable of storing a quiescent volume of water which is substantially greater than the instantaneous requirements of the water treatment plant. In view of the fact that the interior of the conduits is isolated from the main body of water, a substantially quiescent body of stored water is provided in the conduits and the sediment within the quiescent water settles out and accumulates in the base of each conduit. The coarser sediment settles out closer to the input end of the conduits and the finer sediment settles out towards the discharge end thereof.

In order to flush the conduits to remove accumulated sediment, it is only necessary to open the closure flaps 102 at the output ends of the conduits. Having opened the flaps 102, the conduits are open to receive water flowing in the downstream direction so that the natural flow of the water will tend to flush the sediment out of the conduits. Thus the flushing of the conduits is a simple and an inexpensive process.

In a water treatment plant requiring a total flow rate through the manifold 104 of the order of about 14,000 U.S. gallons per minute, the settling enclosure may consist of 24 rigid plastic conduits each having a four foot diameter and measuring 370 feet in length and arranged in a side by side relationship. In an alternative construction, the settling enclosure may consist of a single conduit extending over a considerable length. For example, one hour of detention time at a flow of 20,000,000 U.S. gallons per day may be provided by a single four foot diameter conduit measuring about 9,000 feet in length. This single conduit is capable of functioning in the same way as the plurality of conduits described above.

From the foregoing it will be apparent that the present invention provides a simple and inexpensive form of submerged settling enclosure for use with a water processing plant to increase the utility of a water processing plant by providing a source of water of substantially uniform turbidity.

Various modifications of the present invention will be apparent to those skilled in the art without departing from the scope of the invention. For example, the shape and number of enclosures may be different from that illustrated in the preferred embodiment. The enclosures should, however, serve as a barrier against strong current, turbulence, wave action and the wall of the enclosure should be opaque to prevent the passage of sunlight to the enclosure.

The use of a submerged settling enclosure according to an embodiment of the present invention will serve to increase the number of installations in which the new direct filtration technique may be employed. In addition, it will permit the process to employ optional flocculents such as alum and/or ferric chloride and the like.

The settling tank of the present invention can be installed in large open reservoirs to provide a continuous supply of water to a water treatment plant which is within the turbidity requirements of polution control agencies under a wide range of turbidity conditions within the water of the reservoir. Similarly, a quiescent area can be provided in an aeration tank without the need for a separate settling basin.

A typical installation may employ a submerged settling enclosure such as the semi-sphere illustrated in FIG. 4 of the drawings having a 60′ diameter and will provide one hour of detention for a flow rate of 20 MGD. In an alternative construction, a semi-spherical segment having a 120′ diameter and 20′ altitude will provide about one hour detention for a flow rate of 20 MGD and ten such units may be combined in series to provide a flow rate of 200 MGD. A settling tank of cubic configuration measuring 75' by 75' by 20' in altitude will provide about one hour detention for a flow rate of 20 MGD.

In an installation in which the weighted members which hold down the side walls of the web are flexible and filled with flexible material, the weighted members may have sufficient longitudinal flexibility to rest upon the bed of a body of water without requiring a specially prepared base. As previously indicated, sand makes a suitable filling for a flexible plastic pipe. A sand filled plastic pipe may have sufficient weight to weigh the side walls of the web down and sufficient flexibility to conform to an uneven bed of a reservoir or the like. In a further modification, the enclosure which is formed at the lower edge of the web in FIG. 3 may be filled with the weighing material without being enclosed in a plastic pipe.

In a further modification of the present invention, the buoyant pipes 28 may be replaced by lengths of polyethylene foam which may have a cylindrical or any desired cross-sectional configuration. In addition, the buoyant members may be secured with respect to the flexible web 22 so as to be retained in any required positions such as the positions illustrated in FIG. 2 of the drawings. The buoyant members may be secured by any suitable means such as by the formation of a sleeve by extending a portion of flexible material diagonally across the corners between the side and top walls of the enclosures illustrated in FIG. 2 so that the buoyant members may fit longitudinally within the sleeve formed thereby.

In yet another modification, the flexible enclosure wall 2 of the dome-shaped enclosure illustrated in FIG. 4 may be provided with buoyancy supports secured with respect to the flexible enclosure wall for supporting the flexible enclosure wall in an extended position. The buoyancy member may be located internally or externally of the flexible enclosure wall. In one preferred form, the buoyancy members may be in the form of lengths of polyethylene foam radiating outwardly from the apex of the dome configuration to spaced locations along the lower peripheral edge of the dome and being secured over their full ends with respect to the flexible enclosure wall. The buoyancy members would, thus, serve to retain the dome configuration in this extended position illustrated in FIG. 4 in use.

It will also be understood that in the selection of the various materials used in the construction of the device according to the present invention, care should be taken to ensure that all materials are compatible with Government Regulations relating to materials for storing potable water.

From the aforegoing, it will be apparent that the present invention provides a simple and inexpensive form of submerged settling enclosure which will considerably increase the efficiency of operation of many water treatment plants which draw water from large bodies of water subject to substantial variations in turbidity. Of importance is the fact that the device of the present invention can be used without the need to acquire additional real estate as would be required for normal settling tanks. The settling enclosures of the present invention are submerged in the main body of the reservoir and thus utilize the otherwise unused bed of the reservoir or the like.

What I claim as my invention is:

1. A submersible settling enclosure comprising:

(a) an enclosure wall, in the form of a flexible membrane, defining a settling chamber;

(b) a large body of water having a bottom bed surface and an open top surface;

(c) means for retaining peripheral edge portions of said flexible enclosure wall membrane in a position sealed against the bed surface of said large body of water;

(d) buoyant floatation means located within said flexible enclosure wall membrane and operative for supporting a portion of said enclosure wall above said bed surface to maintain the settling chamber in an expanded configuration when submerged;

(e) input passage means opening directly through said flexible enclosure wall for placing the settling chamber in direct unrestricted fluid communication with the body of water in which it is to be submerged so as to admit water to said settling chamber, and the enclosure having an output passage opening outwardly from said settling chamber at a point remote from said input passage means for discharging water therefrom, and (f) suction conduit means connected to withdraw water by suction from the output passage and convey it to an onshore water treatment plant, the output passage being spaced from the input passage means and the settling chamber being proportioned such that the distance travelled by the water through the chamber is great as compared with the height of the wall membrane above said bed.

2. A submersible settling enclosure as claimed in claim 1 including air input passage means communicating with said settling chamber for admitting air thereto to maintain the enclosure in an expanded configuration regardless of the level of water therein and to provide a compressible air filled enclosure above the water which serves to relieve stresses applied to the enclosure wall in use.

3. A submersible settling enclosure as claimed in claim 1 wherein said flexible enclosure wall is folded upon itself to form a series of compartments each of which includes means for retaining peripheral edge portions thereof sealed against said bed, said compartments being connected to one another in series by connecting passages, the connecting passages of each compartment being remote from one another so that water must pass through substantially the full length of each compartment before passing to the next compartment in the series, said input passage communicating with a first compartment in the series and said output passage communicating with the last compartment of the series.

4. A submersible enclosure as claimed in claim 3 wherein said means for retaining peripheral edge portions of said enclosure in a position sealed against the bed surface of a large body of water includes weighting means at said peripheral edge and extending longitudinally thereof.

5. A submersible enclosure as claimed in claim 4 wherein said weighting means is flexible to accommodate irregularities in the bed surface of the body of water.

6. A submersible enclosure as claimed in claim 1 wherein said means for retaining peripheral edge portions of said enclosure in a position sealed against the bed of a large body of water includes weighting means at said peripheral edge and extending longitudinally thereof.

7. A submersible enclosure as claimed in claim 6 wherein said weighting means is flexible to accommodate irregularities in the bed surface of the body of water.

8. A water treatment system comprising:

(a) a water treatment plant adapted to treat water and deliver treated water to an onshore water distribution system;

(b) a large main body of water having a bottom bed surface and an open top surface;

(c) a settling enclosure submerged beneath the open top surface of said main body of water and comprising a settling chamber having a flexible enclosure wall sealed against the bottom bed surface of said body to provide a space which is isolated from the main body of water;

(d) buoyant floatation means located within said settling chamber for supporting a portion of said flexible enclosure wall above said bottom bed surface to maintain the settling chamber in an expanded configuration when submerged for enclosing a substantially quiescent body of water located within said settling chamber;

(e) input passage means opening directly from said settling chamber to said main body of water for admitting water to said settling chamber;

(f) suction output conduit means communicating between said settling chamber and said water treatment plant for withdrawing water by suction from said quiescent body of water and conveying it to said water treatment plant for treatment thereby prior to delivery as aforesaid, the output conduit means being spaced from the input passage means and the chamber being proportioned such that the distance travelled by the water through the chamber is great as compared with the height of the chamber above said bottom;

(g) said quiescent body of water having a volume which is substantially greater than the instantaneous requirements of said water treatment plant whereby water entering said settling chamber is held in a substantially quiescent state within said settling chamber for a period of time sufficient to ensure that the turbidity of water drawn from the quiescent body by way of said output conduit is substantially constant and unaffected by turbidity conditions in the main body of water.

9. A water treatment system as claimed in claim 1 wherein said enclosure wall is a flexible member which will yield in response to the pressure applied thereto by the main body of water.

10. A water treatment system as claimed in claim 9 wherein said flexible member is made from a light impervious material which serves to inhibit the growth of algae and vegetation within said settling chamber.

11. A water treatment system as claimed in claim 10 wherein said light impervious material is made from a plastics material.

12. A water treatment system as claimed in claim 8 including a support structure supporting said enclosure wall in an extended position.

13. A water treatment system as claimed in claim 8 including at least one air pocket disposed within said settling chamber above said quiescent body of water to prevent the chamber collapsing inwardly as water is drawn outwardly through the output conduit and to provide a compressible air filled chamber which serves to relieve stresses applied to the enclosure wall in use.

14. A water treatment system as claimed in claim 8 wherein said input passage means has a greater capacity than said output conduit means so that water cannot be withdrawn from said chamber at a rate greater than it is admitted to said chamber.

15. A water treatment system as claimed in claim 8 wherein said settling enclosure is formed with a plurality of compartments which are connected to one another in series, said input passage opening into a first of said compartments in the series and said output passage opening outwardly from the last compartment in the series such that water entering the enclosure must travel through each compartment before being discharged from the enclosure.

16. A water treatment system as claimed in claim 8 including means for admitting a water treatment polymer to water entering said enclosure.

17. A water treatment system as claimed in claim 1 including means for admitting air to said settling enclosure to maintain said enclosure in an expanded configuration.

18. A water treatment plant as claimed in claim 8 wherein said enclosure wall consists of at least one conduit member.

19. In a water treatment plant which extracts water from a flowing stream of water, the improvement of:

(a) a settling enclosure comprising at least one conduit member having an input end and an output end, said input end opening into said stream of water in a downstream direction and being located downstream from the output end, the output end of each conduit facing upstream, (b) closure means at said output end of each conduit for preventing the direct discharge of water from each conduit, the closure means of each conduit being adapted to be opened to allow the flowing stream to enter each conduit member to flush accumulated solids from each conduit as required, the conduit or conduits having a total capacity capable of storing a quiescent volume of water which is substantially greater than the instantaneous requirements of a water treatment plant, (c) output passage means communicating between the output end of each conduit and said water treatment plant for conveying water to said treatment plant.

20. A water treatment plant as claimed in claim 19 wherein said closure means at said output end of each conduit is releasable to open said output end to permit flushing of settled material from said settling enclosure and said output passages oriented to open in an upstream direction whereby the flow of water in the stream may be directed through said output end of said conduit to effect flushing.

21. A water treatment plant as claimed in claim 19 including means for directing and admitting water treatment polymer to the input end of each conduit.

22. A water treatment plant as claimed in claim 21 including baffle means at the input end of each conduit to induce to effect a thorough mixing of water and treatment polymer at said input end.

23. A water treatment plant as claimed in claim 21 wherein the means for directing and admitting water treatment polymer to the input end of each conduit comprises a manifold connected in parallel to the input end of each conduit.

24. A water treatment plant as claimed in claim 19 including anchor means for securing each conduit with respect to the bed of the stream.

25. A water treatment plant as claimed in claim 19 wherein said stream is a shallow stream which may be less than twice the height of the conduits which are located in the stream.

26. A water treatment plant as claimed in claim 19 wherein the output ends of the conduits are connected in parallel to a manifold which communicates with the water treatment plant.

* * * * *